US008419480B2

(12) United States Patent
Yu et al.

(10) Patent No.: US 8,419,480 B2
(45) Date of Patent: Apr. 16, 2013

(54) BOARD-MOUNTED ELECTRICAL CONNECTOR

(75) Inventors: Wang-I Yu, Jhonghe (TW); Chih-Che Chen, Jhonghe (TW); Hung-Chi Tai, Jhonghe (TW)

(73) Assignee: Alltop Electronics (Suzhou) Co., Ltd, Taicang (CN)

( * ) Notice: Subject to any disclaimer, the term of this patent is extended or adjusted under 35 U.S.C. 154(b) by 159 days.

(21) Appl. No.: 13/036,658

(22) Filed: Feb. 28, 2011

(65) Prior Publication Data

US 2012/0164890 A1 Jun. 28, 2012

(30) Foreign Application Priority Data

Dec. 23, 2010 (CN) ..... 2010 1 0602631

(51) Int. Cl.
*H01R 24/00* (2011.01)
*H01R 33/00* (2006.01)

(52) U.S. Cl.
USPC ..... 439/660; 439/79

(58) Field of Classification Search ..... 439/660, 439/607.39, 607.36, 60.723
See application file for complete search history.

(56) References Cited

U.S. PATENT DOCUMENTS

| | | | | |
|---|---|---|---|---|
| 6,619,968 | B2 * | 9/2003 | Xu | 439/79 |
| 7,748,999 | B1 * | 7/2010 | Sun et al. | 439/79 |
| 8,016,620 | B1 * | 9/2011 | Chiu et al. | 439/660 |
| 8,021,188 | B1 * | 9/2011 | Ma et al. | 439/607.55 |
| 8,038,480 | B2 * | 10/2011 | Wei | 439/660 |
| 2011/0159747 | A1 * | 6/2011 | Tung et al. | 439/660 |

* cited by examiner

*Primary Examiner* — Hae Moon Hyeon
(74) *Attorney, Agent, or Firm* — Sughrue Mion, PLLC

(57) ABSTRACT

A board-mounted electrical connector has an insulating housing, a first contact module, a second contact module, a spacer and a shell encasing the housing, the first and the second module and the spacer. The housing forms a main body defining a receiving space and a mating tongue extending forwardly from the main body. Each of the first and the second contact module has a first/second insert and a plurality of first/second contacts insert-molded in the first/second insert. The spacer is assembled with the first and the second contact module, and defines a plurality of through holes.

10 Claims, 5 Drawing Sheets

BOARD-MOUNTED ELECTRICAL CONNECTOR

BACKGROUND OF THE INVENTION

1. Field of the Invention

The present invention relates to an electrical connector, and more particularly to a board-mounted electrical connector.

2. Description of Related Art

In order to achieve high quality video and audio signals, a type of connector meeting a standard named High Definition Multimedia Interface (HDMI) is taken into use. HDMI is a compact audio/video interface for transmitting uncompressed digital data. It is a digital alternative to consumer analog standards, such as radio frequency (RF) coaxial cable, composite video, S-Video, SCART (Syndicat des Constructeursd' Appareils Radiorécepteurs et Téléviseurs), component video, D-Terminal, or VGA (Video Graphics Array). HDMI connects digital audio/video sources to compatible digital audio devices, computer monitors, video projectors, and digital televisions.

A conventional HDMI connector generally includes 19 electrical terminals which are directly soldered to the printed circuit board. Obviously, the solder speed and success ratio are relevant to the arrangement and stability of the electrical terminals. With the publication of the newest Micro-HDMI interface, more and more portable electrical device needs micro-HDMI connectors to transmit signals.

Therefore, a micro board-mounted connector for delivering HDMI signals is required.

BRIEF SUMMARY OF THE INVENTION

A board-mounted electrical connector in accordance with the present invention has an insulating housing, a first contact module, a second contact module, a spacer and a shell encasing the housing , the first and the second module and the spacer. The housing forms a main body defining a receiving space and a mating tongue extending forwardly from the main body. Each of the first and the second contact module has a first/second insert and a plurality of first/second contacts insert-molded in the first/second insert. The spacer is assembled with the first and the second contact module, and defines a plurality of through holes.

BRIEF DESCRIPTION OF THE DRAWINGS

The present invention is further described with reference to the accompanying drawings in which.

DETAILED DESCRIPTION OF THE INVENTION

Figure 1:
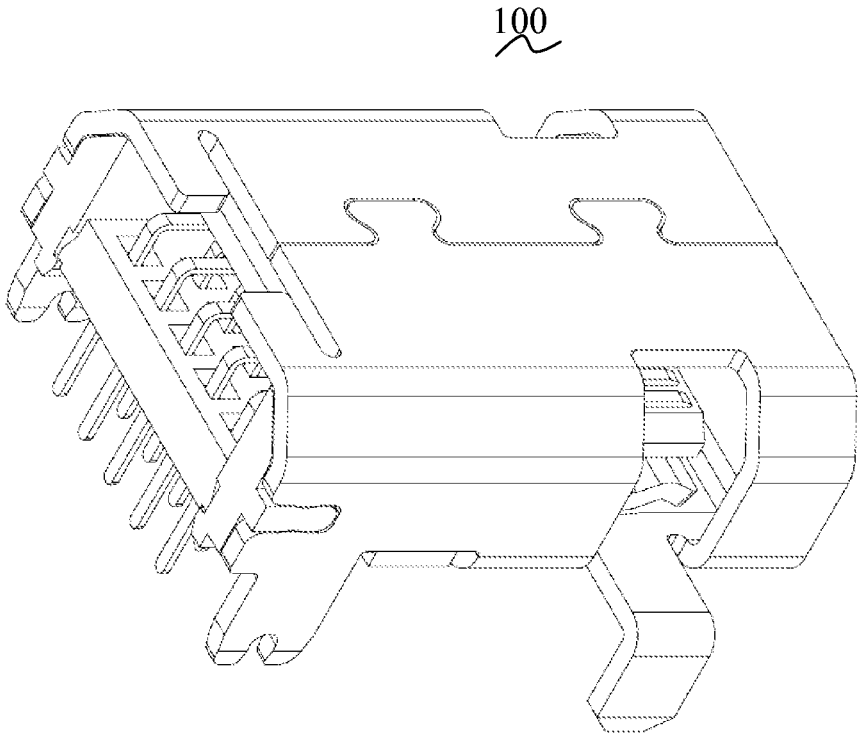
FIG. 1 is a perspective view of a board-mounted electrical connector in accordance with the present invention.

Reference will now be made to the drawing figures to describe the present invention in detail.

Referring to FIG. 1, a board-mounted electrical connector 100 in accordance with the present invention includes an insulating housing 10, a first contact module 20, a second contact module 30, a spacer 40 and a shell 50 encasing the housing 10, the first and the second contact module 20,30 and the spacer 40.

Figure 2:
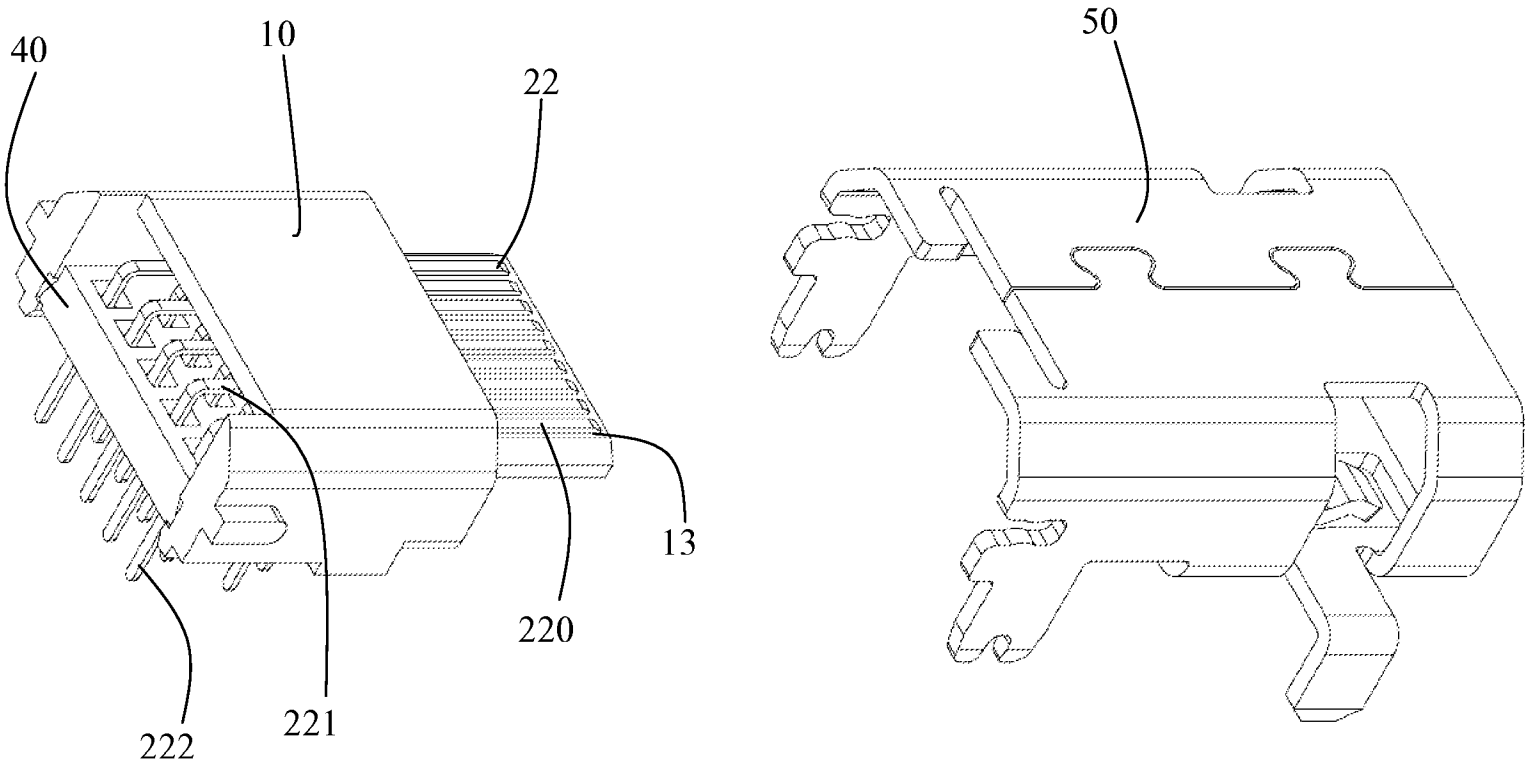
FIG. 2 is a partially exploded perspective view of the board-mounted electrical connector shown in FIG. 1.
Figure 3:
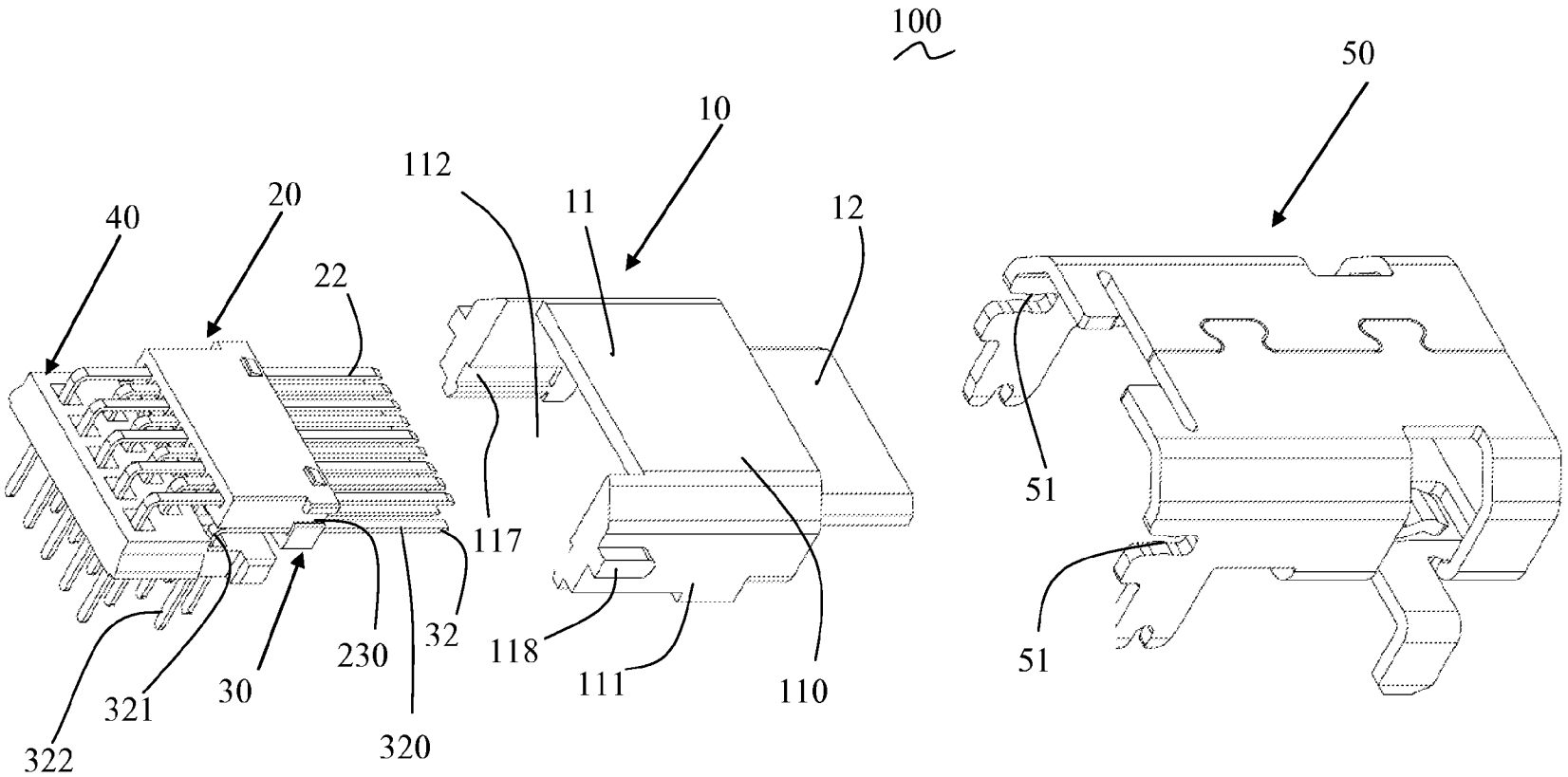
FIG. 3 is an exploded, perspective view of the board-mounted electrical connector shown in FIG. 2.
Figure 4:
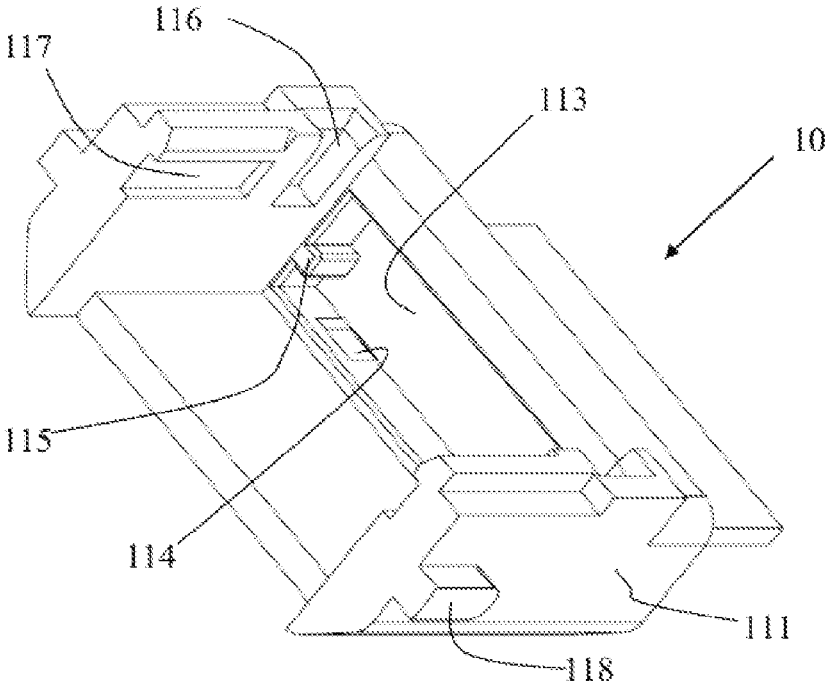
FIG. 4 is a perspective view of an insulating housing of the board-mounted electrical connector.
Figure 5:
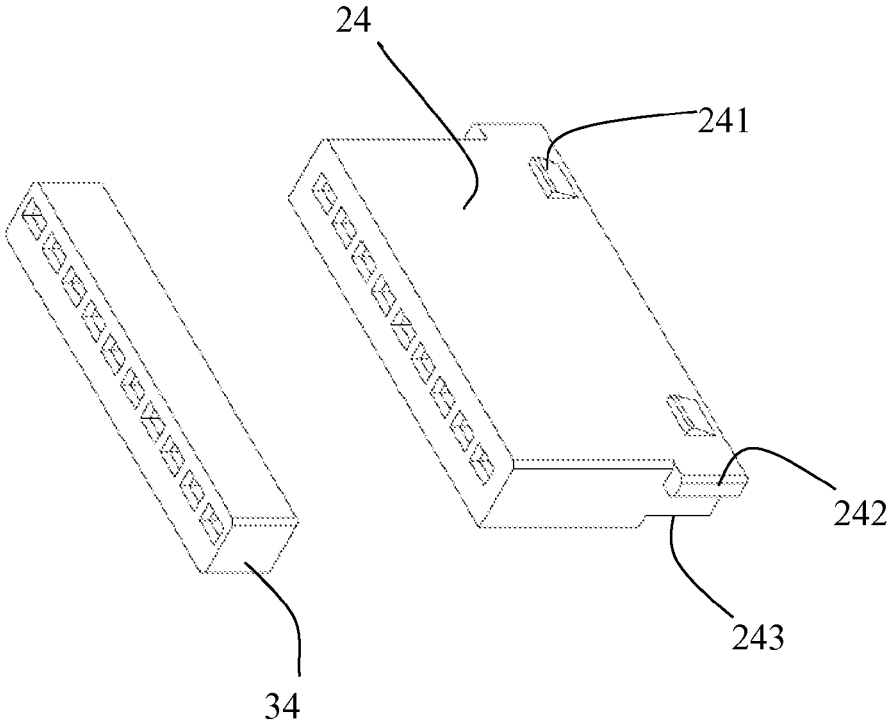
FIG. 5 is a perspective view of a first contact module and a second contact module of board-mounted electrical connector.
Figure 6:
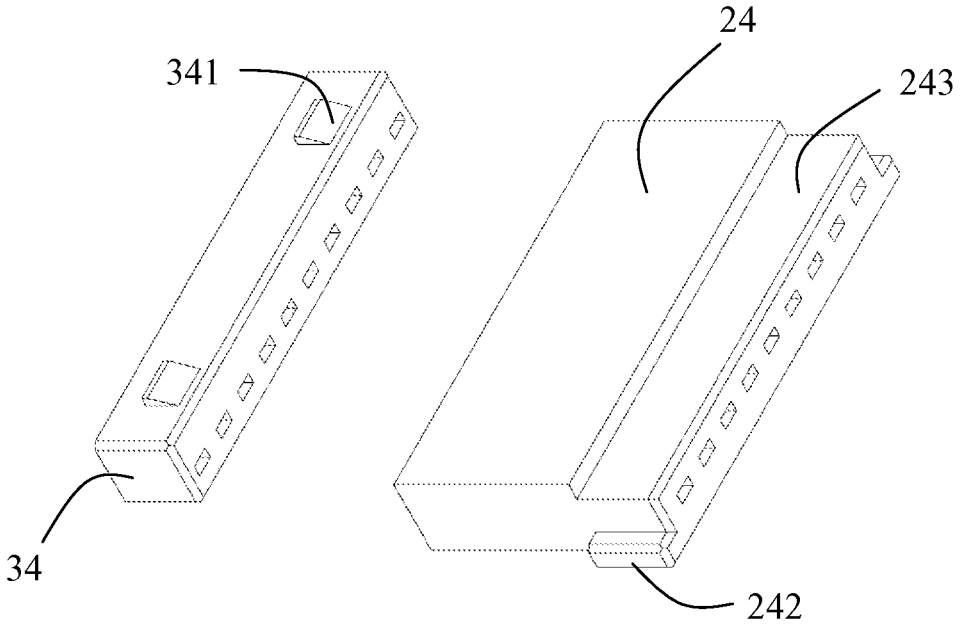
FIG. 6 is view similar to FIG. 5 while with another side.

Together referring to FIGS. 2-4, the insulating housing 10 includes a main body 11 and a mating tongue 12 extending forwardly from the main body 11. The mating tongue 12 defines a plurality of contact channels 13 on opposite upper and lower surfaces. The main body 11 has a top wall 110 and two opposite side walls 111. A receiving space 112 is defined between the top wall 110 and the two side walls 111 for receiving the first and the second contact modules 20, 30 and the spacer 40. The receiving space 112 defines a receiving room 113 adjacent to the mating tongue 12. A top face and a bottom face of the receiving room 113 respectively define recesses 114. Side faces of the receiving room 113 forms blocks 115. The receiving space 112 defines a stopper recess 116 and a sliding slot 117 in opposite inner side walls, respectively. In the preferred embodiment, the stopper recess 116 and the sliding slot 117 are defined along a lengthwise direction of the connector. The sliding slot 117 is opened toward a rear side. The side walls 111 of the insulating housing 10 respectively forms positioning portions 118. In the preferred embodiment, a rear surface of the positioning portions 118 and the rear face of the main body 11 of the housing 10 are coplanar.

Referring to FIGS. 2 and 3, the first contact module 20 comprises a plurality of first contacts 22 and a first insert 24. In the preferred embodiment, the first contacts 22 are insert-molded in the first insert 24. Each of the first contact 22 includes a contact portion 220, a connecting portion 221 and a tail 222 perpendicularly extending to the contact portion 220. The contact portion 220 is received in the contact channel defined in the mating tongue 12 to thereby electrically connect with a complementary connector.

The second contact module 30 comprises a plurality of second contacts 32 and a second insert 34. In the preferred embodiment, the second contact 32 is insert-molded in the second insert 34. Each of the second contact 32 includes a contact portion 320, a connecting portion 321 and a tail 322 perpendicularly extending to the contact portion 320. The contact portion 320 is received in corresponding contact channel 13 defined in the mating tongue 12 for electrically connecting to the complementary connector. The first contacts 22 and the second contacts 32 are respectively located at opposite upper and lower sides of the mating tongue 12.

Turn to FIGS. 5-9 and FIGS. 2 and 3, the first insert 24 forms a pair of projections 241 on an upper surface thereof and a pair of protrusions 242 adjacent to the projections 241, respectively. The projections 241 engage with the recess 114 of the top face of the receiving room 113 of the insulating housing 10 to thereby retaining the first contact module 20 in the housing 10. A step portion 243 is formed on a bottom portion of the first insert 24. The second insert 34 forms a pair of projections 341 on a lower surface thereof. The projections 341 engage with the recesses 114 on the bottom face of the receiving room 113 of the insulating housing 10 to thereby retaining the second contact module 30 in the housing 10. The second insert 34 abuts against the step portion 243 of the first insert 24. In the preferred embodiment, a length of the first insert 24 is larger than that of the second insert 34 because of the different lengths of the first contacts 22 and the second contacts 32. A groove 230 (FIG. 3) is defined between the first insert 24 and the second insert 34 when the two inserts are assembled together. The groove 230 receives the block 115 of the housing 10. Therefore, the first contact module 20 and the second contact module 30 are fixed into the insulating housing 10.

Figure 7:
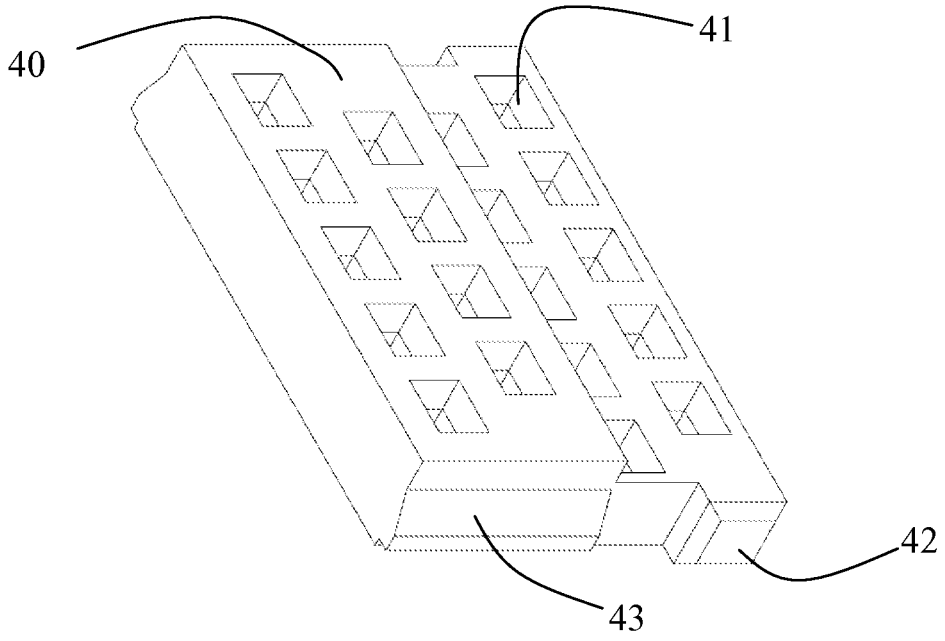
FIG. 7 is a perspective view of a spacer of the board-mounted electrical connector.

Referring to FIG. 7, the spacer 40 is a planar plate with a plurality of through holes 41 defined thereon for inserting the tails 222, 322 of the first contacts 22 and the second contacts 32. In the preferred embodiment, the through holes 41 are arranged at four rows. Front two rows are located at a position lower than rear two rows. As can be understood, the arrangement of the through holes 41 of the spacer 40 is changed with the arrangement of the contacts. A stopper 42 is formed on each side face of the spacer 40 to engage with the stopper recess 116 of the insulating housing 10. A sliding block 43 is formed adjacent to the stopper 42 to engage with the sliding slot 117 of the insulating housing 10. The stopper 42 and the sliding block 43 are formed along the lengthwise direction of the connector. Therefore, the spacer 40 is fixed within the insulating housing 10.

Referring to FIG. 3, the shell 50 is stamped from a piece of metal sheet. As can be understood, the shell 50 can be also formed by other methods known to the persons skilled in the art. A U-shaped slot 51 is defined in the rear portion of the side wall of the shell 50 to engage with the positioning portion 118 of the insulating housing 10. The engagement of the positioning portion 118 and the U-shaped slot 51 restrict the displacement of the insulating housing 10 along the lengthwise and the widthwise directions of the connector with respect to the shell 50.

In this embodiment, the first contact module 20 and the second module 30 are assembled together and then are fixed to the insulating housing 10. In other embodiment, other methods, which increase the rigidity of the assembly of the first and the second inserts 24, 34, can be used. For example, the first contact insert 24 and the second contact insert 34 can be hot melted to the insulating housing 10 in a relatively high temperature. Ultrasonic welding method is also another choice to connecting the housing with the two inserts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A board-mounted electrical connector, comprising:

an insulating housing comprising a main body defining a receiving space and a mating tongue extending forwardly from the main body;

a first contact module having a first insert and a plurality of first contacts insert-molded in the first insert;

a second contact module having a second insert and a plurality of second contacts insert-molded in the second insert; and a spacer assembled with said first and second contact modules and defining a plurality of through holes for tails of said first and said second contacts inserting therethrough;

wherein said first contact module, said second contact module and said spacer are fixedly assembled within said receiving space of said insulating housing;

wherein at least one groove is defined on an interconnecting portion of said first insert and said second insert when said first insert and said second insert are mated with each other;

wherein the receiving space of said insulating housing forms at least one block which is received in said at least one groove;

wherein the spacer forms a stopper and a sliding block at each side face thereof along a lengthwise direction of the connector; and wherein the receiving space defines therein a stop recess and a sliding slot for respectively receiving the stopper and the sliding block and wherein said sliding block is slidable in said sliding slot.

2. The board-mounted electrical connector as claimed in claim 1, wherein each of said first contact and said second contact includes a contact portion, the tail and a connecting portion interconnecting the contact portion and the tail.

3. The board-mounted electrical connector as claimed in claim 2, wherein the mating tongue defines a plurality of contact channels for receiving the contact portions of said first contacts and said second contacts, respectively.

4. The board-mounted electrical connector as claimed in claim 3, wherein the receiving space has a recess recessed from inside wall.

5. The board-mounted electrical connector as claimed in claim 4, wherein the first insert and the second insert are provided with protrusions engaged in said recesses, respectively.

6. The board-mounted electrical connector as claimed in claim 1, wherein the first insert forms a step portion on a bottom portion.

7. The board-mounted electrical connector as claimed in claim 6, wherein the second insert abuts against said step portion of said first insert.

8. The board-mounted electrical connector as claimed in claim 1, further comprising a shell encased therein the first contact module, the second contact module, the housing and the spacer.

9. The board-mounted electrical connector as claimed in claim 8, wherein the insulating housing forms a pair of opposite positioning portions on a rear side face thereof and wherein said shell defines a pair of U-shaped slot receiving said pair of positioning portions therein for limiting the lengthwise movement and the widthwise movement of the insulating housing with respect to the shell.

10. The board-mounted electrical connector as claimed in claim 9, wherein a length of the first contact module is larger than that of the second contact module.

* * * * *